United States Patent [19]

Pflanz

[11] Patent Number: 4,538,133

[45] Date of Patent: Aug. 27, 1985

[54] PASSIVELY DETONATED EXPLOSIVELY-ASSISTED FUSE

[75] Inventor: Herbert M. Pflanz, Westwood, Mass.

[73] Assignee: Phoenix Electric Corporation, Boston, Mass.

[21] Appl. No.: 562,827

[22] Filed: Dec. 19, 1983

[51] Int. Cl.[3] ..... H01H 85/00; H01H 37/76

[52] U.S. Cl. ..... 337/4; 337/30; 337/158; 337/243; 337/401; 200/150 R

[58] Field of Search ..... 337/4, 30, 243, 401, 337/158, 159, 160, 161, 162; 200/150 R; 361/58, 104

[56] References Cited

U.S. PATENT DOCUMENTS

| | | | |
|---|---|---|---|
| 3,851,219 | 11/1974 | Kozorezov et al. | 337/30 |
| 4,176,385 | 11/1979 | Dethlefsen | 337/401 |
| 4,479,105 | 10/1984 | Banes | 337/4 |

*Primary Examiner*—Harold Broome

*Attorney, Agent, or Firm*—Cesari and McKenna

[57] ABSTRACT

An explosively-assisted fuse is passively triggered (without electronics) by means of an auxiliary fuse in series with the main conductor. The auxiliary fuse provides a detonating voltage across a gap formed therein on melting in response to a fault current. The auxiliary fuse is configured to facilitate sizing for a variety of current loads with a standard fuse configuration.

13 Claims, 6 Drawing Figures

PASSIVELY DETONATED EXPLOSIVELY-ASSISTED FUSE

BACKGROUND OF THE INVENTION

A. Field of the Invention

The invention relates to high voltage, high current fuses, particularly to high voltage, high current fuses having explosive elements therein for interrupting a current path on occurrence of a fault current.

B. Prior Art

The electric power industry frequently requires fuses capable of operating at rated voltages in the kilovolt range and above, and with rated currents on the order of 100 amperes and above. For example, a fuse commonly found at power substations might be required to carry currents of a few hundred amperes at voltages of several kilovolts.

In addition to the need for high relability in such fuses in order to prevent damage to expensive equipment both within the system and connected to it, it is necessary that these fuses respond to fault currents (e.g., currents greatly in excess of the rated operating current of the fuse) in a very short time. For example, in standard power systems operating at sixty cycles per second, the fault current can rise to a peak in as little as 4 milliseconds (that is, one quarter of an AC cycle). Since the destructive power of the fault current is proportional to the product of the square of the fault current and the time during which the current persists, it is essential to limit both the magnitude of the fault current and its duration in order to prevent severe damage to equipment.

In particular, it is desirable to interrupt the fault current in a few milliseconds at most. This requires a very fast response time in order to sense the fault current and provide the necessary interruption before the current reaches a dangerous level. In order to meet these requirements, explosively-assisted fuses have been developed. One example of such a fuse is described in an article entitled "The Development of the Current Limiting Protector (CLP)" by Herbert M. Pflanz, Thomas F. Clark and O. J. Albani, the Conference Proceedings of the IEEE Power Engineering Society, Feb. 1–6, 1981. The fuse there described is formed from a main conductive path for carrying the desired current, a main fuse in parallel with the path, and a number of explosive charges positioned adjacent the main conductive path for severing that path when detonated. An electronic sensor monitors the current in the main conductive path and triggers a detonator when this current exceeds a predetermined level corresponding to the occurrence of a fault.

This system has proven highly useful and effective in limiting fault currents to relatively low values in very short periods of time. However, the need for electronic sensing adds significantly to the cost of the fuse and makes installation and use somewhat more cumbersome due to the need for providing power to the electronics. Further, it requires a variety of different sensor elements, or the provision of means for adjusting the current level at which the sensor triggers, in order to accmodate different rated current levels.

DETAILED DESCRIPTION OF THE INVENTION

A. Objects of the Invention

Accordingly, it is an object of the invention to provide an improved explosively-assisted fuse.

Further, it is an object of the invention to provide an improved explosively-assisted fuse having passive triggering.

Further, it is an object of the invention to provide an improved explosively-assisted fuse which is readily adapted for differing loads.

B. Brief Description of the Invention

In accordance with the present invention, an auxiliary fuse is placed in series with a main current conductor that is explosively severable in response to a fault current (that is, a current which exceeds the rated or normal current carrying capability of the fuse by a predetermined amount). When the fault current level is reached, the auxiliary fuse opens ("melts") and thereby generates a voltage across the gap intermediate its terminals. This gap voltage is applied to a detonator which detonates the explosive charge and thereby severs the main current conductor. The current through this conductor is then commutated into a main fuse in parallel with the main conductor as is the case in known explosively-assisted fuses, and the current is interrupted when the main fuse melts in response to the excess current flowing through it.

The auxiliary fuse is formed from first and second segments of electrically conductive material having good thermal conductivity as well, e.g., copper. These are connected in series with the main conductor but are separated by a gap. The gap is bridged by one or more electrically conductive elements, preferably in the form of flat strips, which extend between the two segments and which carry the main current therebetween. These strips are formed from a material having a well defined melting $i^2t$ characteristic (where i is current and t is time), e.g., silver. The mass of these strips is substantially less than that of the first and second conductive segments, and the gap they must bridge is relatively short. Accordingly, the conductive segments serve as thermal heat sinks for these strips so as to maintain their temperature below the melting level of these strips when carrying rated current (that is, the current for which the fuse is designed to operate continuously under normal operating conditions).

In response to fault currents, however, (that is, currents exceeding the rated current level by a defined amount), heat is generated in these strips at a rate in excess of the rate at which it can be removed by the conductive segments, with the result that the temperature of the strips rises to the melting point and the strips thereupon melt ("melt") and create an opening across which a gap voltage appears. This voltage is applied to a detonator via a pair of conductors attached to opposite ends of the gap; in response to this voltage, the detonator fires the explosive charge to sever the main conductor and thereby commutates current into the main fuse for subsequent current interruption. The entire process occurs in a time comparable to that provided by elecronically-triggered explosively-assisted fuses.

DETAILED DESCRIPTION OF THE INVENTION

The foregoing and other and further objects and features of the invention will be more readily understood on reference to the following detailed description of the invention, when taken in conjunction with the accompanying drawings, in which.

Figure 1:
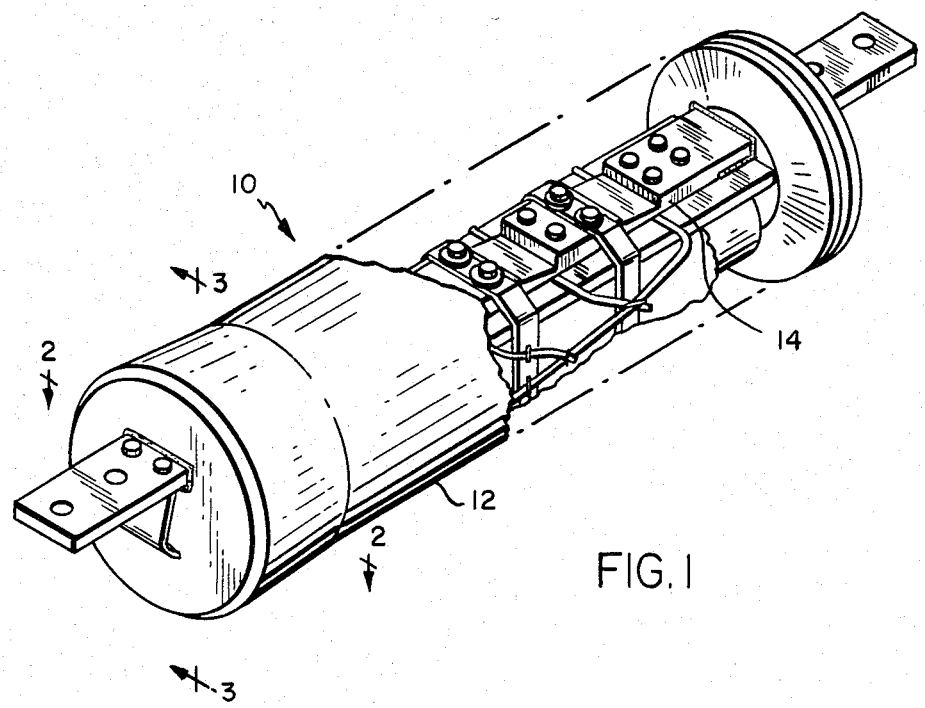
FIG. 1 is a view in perspective of a explosively-assisted fuse in connection with the present invention.
Figure 4:
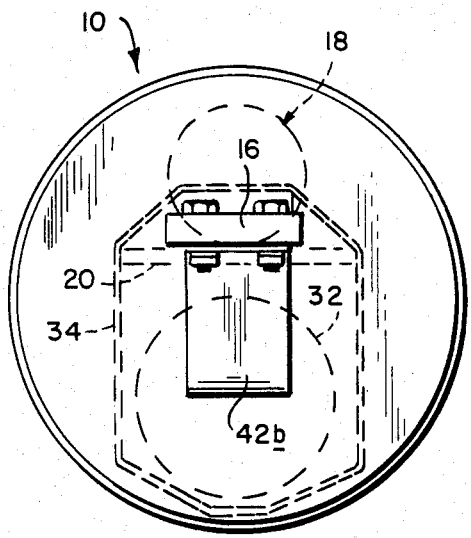
FIG. 4 is an end view of the fuse of FIG. 1.
Figure 2:
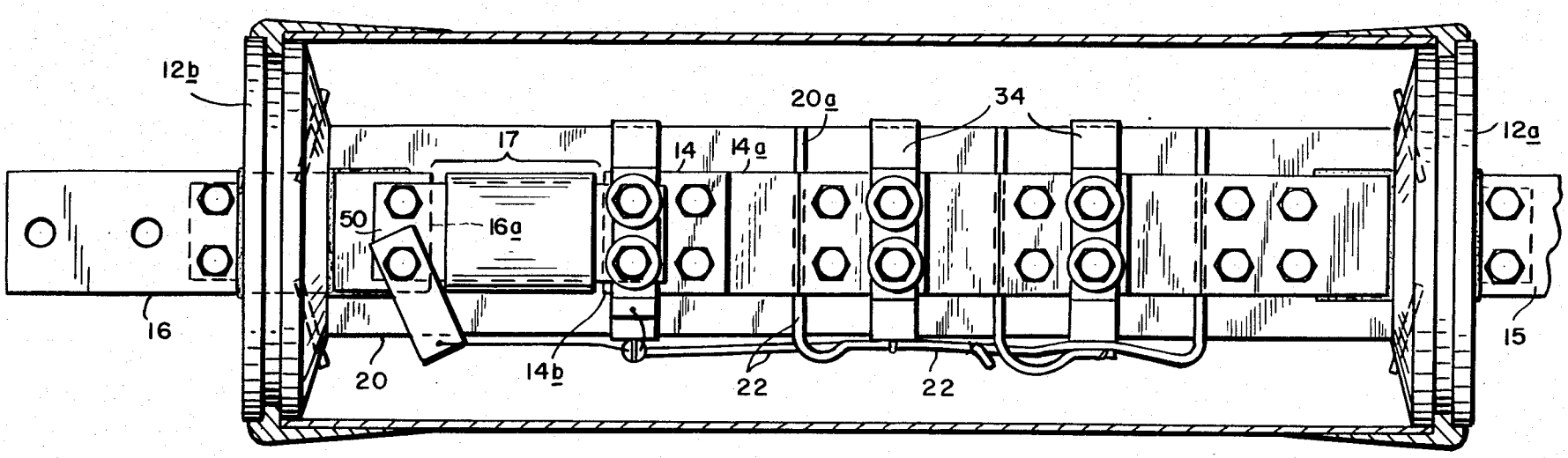
FIG. 2 is a horizontal sectional view of the fuse of FIG. 1 along the lines 2—2 of FIG. 1.
Figure 3:
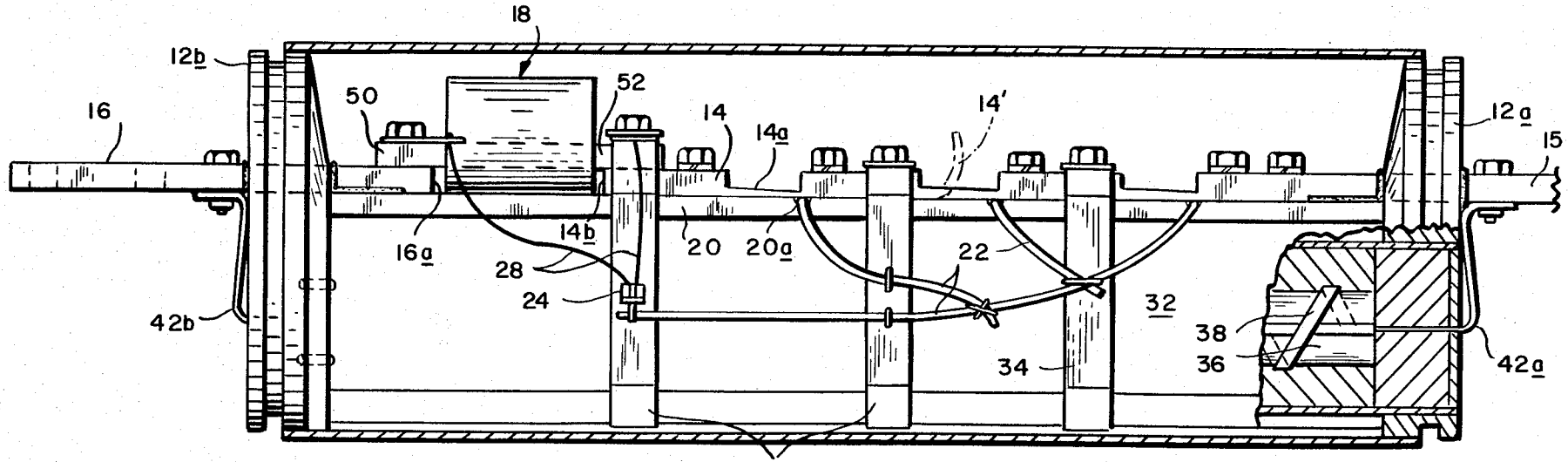
FIG. 3 is a vertical sectional view of the fuse of FIG. 1 along the lines 3—3 of FIG. 1.

In FIGS. 1-3, an explosively-assisted fuse 10 has an electrically non-conductive shell 12 enclosing a longitudinally extending continuous main current conductor 14. Conductor 14 is in the form of a generally rectangular bar of substantial thickness, but has portions 14*a* of reduced thickness to facilitate current interruption as described below. The conductor 14 extends through one wall, 12*a*, of the casing 12 and terminates exteriorly of this casing in a terminal 15 for connection to other circuit elements. The other end, 14*b*, of the conductor terminates interiorly of the casing. A terminal 16 extends through a second end wall, 12*b*, of the casing and terminates interiorly of this casing. An interior end face 16*a* of this terminal, together with end face 14*b* of main conductor 14, form a gap 17 (FIG. 2) therebetween. The gap 17 is bridged by an auxiliary fuse 18, which is described in more detail hereinafter.

Terminal 16 and main conductor 14 rest on an electrically non-conductive backing wall 20. The backing wall has grooves 20*a* formed transversely therein at one end of each of the diminished sections 14*a* of the main conductor. Explosive charges 22 of a linear explosive are fitted into each of these grooves and are connected in common to a detonator 24. The charges are secured on strips 34. The detonator is a standard electric detonator which responds to a voltage across it to detonate a fused charge and need not be described in further detail. A pair of trigger wires 28 extend from the detonator to the opposite ends of the auxiliary fuse 18. An inner tubular portion 32 is located below the main conductor 14. It carries within it a mandrel 36 around which is wound a main fuse 38 immersed in a body of generally non-conductive material 40 such as sand. An electrically conductive strap 42*a* connects one end of main fuse 38 to terminal 15, while a similar strap 42*b* connects the other end (not shown) of main fuse 38 to terminal 16. The resistance between terminals 15 and 16 along the path comprising the fuse 38 is sufficiently greater than the resistance along the path comprising conductor 14 and auxiliary fuse 18 that most of the current flows through the latter path, as opposed to the former during normal operation. However, when the latter path is interrupted in response to the detonation of the explosive charge, the current is commutated to the main fuse 38 which thereupon melts to provide the final current interruption.

Figure 5:
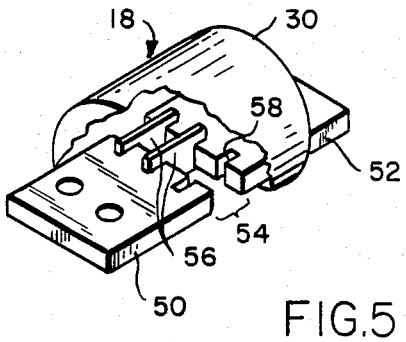
FIG. 5 is an exploded view in perspective showing the auxiliary fuse in more detail.

Turning now to FIG. 5, the auxiliary fuse 18 is shown in more detail. The fuse is formed from first and second electrically-conductive segments or blocks 50, 52, respectively, of a material having good thermal conductivity (e.g., copper) and spaced apart to define between them a gap 54 across which the detonation voltage is to appear. Bridging the gap are a plurality of strips 56 of electrically conductive material having well-defined $i^2t$ characteristics, e.g., silver. These strips are placed in spaced slots 58 in the segments 50, 52. They are relatively thin and short and thus have a relatively small mass in comparison with the segments 50, 52 such that the segments 50, 52 serve as an effective heat sink for the heat generated in these strips under rated current conditions. The cross-sectional area of each of the strips is determined primarily by the normal (rated) current which is to flow through them. The spacing 54 is determined, in large part, by the magnitude of the voltage required to trigger the detonator 24 (FIG. 3). The length of these strips and their thermal conductivity, also affects the rate at which heat is transferred from the strips 56 to the segments 50, 52, and thence to the environment. The relative sizes of the strips and segments for a particular load can readily be determined from elementary heat flow calculations, as well as from trial and error. As an example of a sample physical embodiment, I have used segments of copper 2-3 inches long, $1\frac{1}{2}$ inches wide, and $\frac{1}{4}$ inch thick bridged by silver, from one to three strips $\frac{3}{8}$ inch long, $\frac{1}{4}$ inch wide, and 0.004 inch thick to form a gap of approximately $\frac{1}{4}$ inch thick to fuse currents of the order of from 200 to 500 amperes at 15 kilovolts.

During operation around rated current levels, heat is carried away from the strips 56 at a rate which is approximately equal to the rate at which it is generated in them by virtue of the current flowing through them. When a fault current occurs, however, the current amplitude starts to increase substantially above the normal amplitude, and the square of this current thus increases at an even faster rate. In response, the strips 56 generate heat at a rate faster than that at which it can be carried away by the segments 50, 52, and the temperature of these strips rises to the melting temperature of the material of these strips. When this occurs, the strips vaporize and the gap 54 is no longer bridged. Accordingly, a voltage is generated across this gap, and this voltage triggers the detonator 24 via the leads 28 to thereby ignite the explosive charges 22. This severs the main conductor 14, and folds the segments 14*a* of reduced thickness up and back as shown in dotted lines at 14' in FIG. 3. The voltage across the newly formed gaps commutates the current to the parallel path formed by the main fuse 38. This fuse thereupon melts in response to the sudden excess current through it and the path between the terminals 15 and 16 is thereby opened; current flow then ceases.

Figure 6:
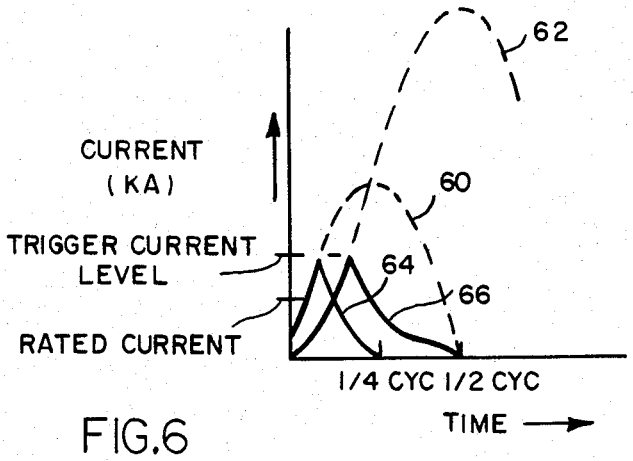
FIG. 6 is a sketch of current through the fuse as a function of time, showing the response of the fuse to fault currents.

The sequence of events described above occurs in a very brief interval of time, as may be seen on reference to FIG. 6 of the drawings. Dotted curve 60 shows the prospective symmetric fault current as a function of time, while dotted curve 62 shows the prospective asymmetric fault current. The solid lines 64, 66 show the actual current corresponding to these fault currents. As may be seen, the actual current through the fuse 10 follows the fault current as it rises above the rated current levels until a predetermined trigger current level is reached. This level is established, for a given auxiliary fuse, by the thermal and electrical conductivity, cross-section, and length of the fuse strips 56 in relation to the thermal chracteristics heat-sink elements 50, 52, and melting $i^2t$ as discussed above. On reaching the trigger current level, the strips 56 vaporize to disrupt current flow therethrough. Detonation thereupon occurs to sever the main conductor and commutate current to the main fuse which vaporizes in a short time under the substantial current overload. Thus, the current flowing through the fuse decreases as indicated by the drop in the solid lines 64, 66. Accordingly, for both the symmetric and asymmetric fault, the peak current passing through the fuse (commonly termed the "let through" current) is limited to a value substantially less than the peak of the fault current, and this occurs in a time substantially less than one quarter cycle of the AC current. By the time that one half cycle has passed, the current has essentially dropped to zero.

As a specific example of the foregoing, an explosively-assisted fuse constructed in accordance with the present invention when tested in a circuit carrying 200 amperes rated current and subjected to a 20 kiloampere r.m.s. symmetric short circuit current demonstrated a let through current of only 12.5 kiloamperes. This is less than the let through current allowed in conventional fuses.

The removability of the auxiliary fuse 18 readily allows substitution of this fuse in order to provide various current ratings for the fuse 10 with the same main fuse body. Of course, where a large number of fuses of the same rating are required, the auxiliary fuse can be formed integral with the main conductor 14.

CONCLUSION

From the foregoing it will be seen that I have provided an improved explosively-assisted fuse. The fuse provides passive triggering of the explosive charges used to sever the main conductive element, and does so in a time which is short in comparison with a quarter cycle of the fault current. It carries a high continuous rated current, but restricts the let through current to a favorably low value. Accordingly, the "let through" $i^2t$ of the fuse is at a comparatively low level, and protection to power line and user equipment is enhanced.

It will be understood to those skilled in the art that the foregoing description of a specific physical implementation is illustrative only, the scope of the invention being defined with particularity in the claims.

Having illustrated and described your invention, I claim:

1. In an explosively-assisted fuse having a main current conductor, explosive charge proximate to said conductor for severing said conductor when said charge is detonated, a detonator responsive to a voltage applied thereto for detonating said charge, and a main fuse in parallel with said main conductor for receiving current from said conductor when said conductor is severed, the improvement comprising an auxiliary fuse in series with said main conductor and providing a voltage across opposite ends thereof on melting in response to fault currents therethrough, and means connecting said detonator across said auxiliary fuse for receiving a detonating voltage therefrom.

2. An explosively-assisted fuse according to claim 1 in which said main fuse is in parallel with the series combination of said auxiliary fuse and said main conductor.

3. An explosively-assisted fuse according to claim 1 in which said auxiliary fuse has a fault current capability resulting in melting within a predetermined maximum time interval after exceeding a predetermined fault current level.

4. An explosively-assisted fuse according to claim 3 in which said auxiliary fuse has a fault current capability resulting in melting in a fraction of a cycle of AC voltage applied thereto at fault current levels.

5. An explosively-assisted fuse according to claim 1 in which said auxiliary fuse comprises first and second conductive segments of a first conductive material spaced apart from each other and bridged by at least a third conductive segment of a second conductive material.

6. An explosively-assisted fuse according to claim 5 in which the segments of said first conductive material provide a heat sink for maintaining said second conductive material at a temperature below its melting temperature at the rated current of the fuse, but insufficient to maintain the second conductor at a temperature below its melting temperature when carrying a fault current.

7. An explosively-assisted fuse according to claim 6 in which said second conductive material comprises a plurality of strips bridged across the segments of said first conductive material.

8. An explosively-assisted fuse according to claim 6 in which said second conductive material comprises a plurality of strips having opposite ends thereof secured in facing transverse slots of said first and second conductive segments.

9. An explosively-assisted fuse according to claim 8 in which said strips are formed substantially of silver.

10. An explosively-assisted fuse having a main current conductor, explosive charge proximate to said conductor for severing said conductor when said charge is detonated, a detonator responsive to a voltage applied thereto for detonating said charge, and a main fuse in parallel with said main conductor for receiving current from said conductor when said conductor is severed, the improvement comprising an auxiliary fuse in series with said main conductor and, together with said conductor, in parallel with said main fuse, said auxiliary fuse providing a voltage across opposite ends thereof on melting in response to a fault current therethrough, and means connecting said detonator across said auxiliary fuse for receiving a detonating voltage therefrom.

11. An explosively-assisted fuse according to claim 10 in which said auxiliary fuse comprises first and second segments of a first conductive material spaced apart from each other and bridged by a plurality of relatively short strips of a second conductive material of substantially less total mass than said first conductive material and carrying main current therethrough, the segments of said first conductive material providing a heat sink for removing heat from said strips at a rate sufficient to maintain said strips at a temperature below their melting temperature while carrying rated current therethrough, but insufficient to maintain said strips below their melting temperature when carrying fault current.

12. An explosively-assisted fuse according to claim 11 in which said strips are fixed at opposite ends thereof in transverse slots in the respective first and second conductive segments.

13. An explosively-assisted fuse according to claim 12 in which said auxiliary fuse is removably connected in series with said main conductor.

* * * * *